US008096592B2

(12) United States Patent
Mrkovic et al.

(10) Patent No.: US 8,096,592 B2
(45) Date of Patent: Jan. 17, 2012

(54) LOCKING PIVOT ACTUATOR

(75) Inventors: Dragan Mrkovic, Newmarker (CA); Jason David Niskanen, Keswick (CA); Andrew R. Daniels, Sharon (CA)

(73) Assignee: Magna Closures Inc., Newmarket (CA)

( * ) Notice: Subject to any disclaimer, the term of this patent is extended or adjusted under 35 U.S.C. 154(b) by 820 days.

(21) Appl. No.: 12/089,961

(22) PCT Filed: Sep. 21, 2006

(86) PCT No.: PCT/CA2006/001545

§ 371 (c)(1),
(2), (4) Date: Jun. 23, 2008

(87) PCT Pub. No.: WO2007/041829

PCT Pub. Date: Apr. 19, 2007

(65) Prior Publication Data

US 2009/0217717 A1 Sep. 3, 2009

(51) Int. Cl.
*E05C 3/06* (2006.01)

(52) U.S. Cl. ..... 292/201

(58) Field of Classification Search ..... 292/201, 292/216, DIG. 23, 336.3, 144, 143, 145, 292/267, 268, 280, 274, DIG. 66, DIG. 30; 74/469; 16/485

See application file for complete search history.

(56) References Cited

U.S. PATENT DOCUMENTS 4,631,094 A * 12/1986 Simpson et al. ..... 148/563
4,635,454 A * 1/1987 Brown ..... 70/139
4,806,815 A 2/1989 Honma
4,929,007 A 5/1990 Bartczak et al.
5,570,915 A * 11/1996 Asadurian ..... 292/242
5,722,921 A * 3/1998 Simonson ..... 482/100
6,008,992 A * 12/1999 Kawakami ..... 361/726
6,310,411 B1 * 10/2001 Viallet ..... 307/125
6,328,353 B1 12/2001 Barczynski et al.
6,374,608 B1 4/2002 Corris et al.
6,390,878 B1 5/2002 Zhou et al.
6,579,213 B1 * 6/2003 Webber et al. ..... 482/100
6,601,418 B2 * 8/2003 Huang ..... 70/280
6,786,070 B1 9/2004 Dimig et al.
6,824,505 B1 * 11/2004 Chang ..... 482/95
6,871,519 B2 3/2005 Butera et al.
6,969,934 B2 11/2005 Neubauer et al.
6,972,659 B2 12/2005 von Behrens et al.
7,380,843 B2 * 6/2008 Alacqua et al. ..... 292/163
7,810,852 B2 * 10/2010 Alacqua et al. ..... 292/201
2003/0025338 A1 * 2/2003 Mori et al. ..... 292/196
2003/0045406 A1 * 3/2003 Stone ..... 482/100

(Continued)

FOREIGN PATENT DOCUMENTS

EP 1279784 A1 1/2003

*Primary Examiner* — Thomas Will
*Assistant Examiner* — Matthew D Troutman
(74) *Attorney, Agent, or Firm* — Miller Canfield

(57) ABSTRACT

An actuator is provided that uses two lengths of shape memory alloy (SMA) wire to kinematically couple a first and second lever together. The two SMA wires are routed in generally V-shaped paths around a link pin that is coaxial with the first and second levers. By selectively contracting one of the wires, the link pin slides between a locked and an unlocked position. A locking pin extending from the link pin couples the first and second levers together while the link pin is in the unlocked position.

10 Claims, 1 Drawing Sheet

U.S. PATENT DOCUMENTS

2003/0100413 A1* 5/2003 Huang ..... 482/100
2004/0191556 A1* 9/2004 Jardine ..... 428/610
2005/0146147 A1 7/2005 Niskanen et al.
2006/0237974 A1* 10/2006 Hamm et al. ..... 292/216
2007/0161470 A1* 7/2007 Berryman ..... 482/94

* cited by examiner

LOCKING PIVOT ACTUATOR

FIELD OF THE INVENTION

The invention generally relates to automobile locks and/or latches and more specifically to a vehicle lock controlled by a shape memory alloy actuator.

BACKGROUND OF THE INVENTION

Automobiles often include child locks for preventing doors, especially rear doors, from being opened from within the passenger compartment. Powered child locks typically require an actuator and a lockout control mechanism that is located on the door latch. The main problem with these types of locks is the lack of packaging space in the door to facilitate the actuator and the lockout mechanism. As the costs associated with a power child lock are high when compared to the value this feature adds to a vehicle, it is desirable to provide such a child lock at a minimum cost.

In addition, another desirable feature to include in a vehicle door latching or locking system is a "double lock", wherein, when engaged, both the inside and outside release levers are simultaneously inactive. This feature has conventionally been incorporated into the design of the latch itself, which can often necessitate a very expensive redesign of a pre-existing latch. Since the functions of a child lock and a "double lock" feature are quite similar, it would be desirable to provide a single structure that could provide both functions and thus further reduce costs.

One alternative to using power actuators is use a shape memory alloy (SMA) wire to toggle the locking feature. SMA wires have the ability to contract when supplied with an electric current, and can be used to engage or disengage the lock. However, these systems are not without their own drawbacks. For example, existing linear toggle mechanisms require too much travel, requiring considerable lengths of SMA wire (an expensive component). In addition, depending on the arrangement of the latch components, it can be difficult to supply electrical power to the shape memory actuator. Finally, rotation of the electrical wires in linear toggle mechanisms may cause premature failure of the mechanism, therefore there is high demands on those systems for durability and reliability.

SUMMARY OF THE INVENTION

According to a first aspect of the invention there is provided an actuator. The actuator comprises

- a housing;
- a first lever, pivotally mounted to the housing;
- a second lever, pivotally mounted to the housing;
- a link pin, slidably mounted to the housing;
- a pair of spaced-apart selectively contractible wires, each of the pair of selectively contractible wires connected to the link pin and the housing, and operable to slide the link pin in one of two directions; and
- where sliding the link pin in a first direction kinematically couples the first and second levers and where sliding the link pin in a second direction kinematically decouples the first and second levers.

The object of the present invention is to provide a low-cost actuator for selectively coupling or decoupling two levers together that is simple, reliable and compact. The actuator can be used for multiple functions such as a child lock and a double lock.

BRIEF DESCRIPTION OF THE DRAWINGS

Preferred embodiments of the present invention will now be described, by way of example only, with reference to the attached Figures, wherein.

DETAILED DESCRIPTION OF THE DRAWINGS

Figure 1:
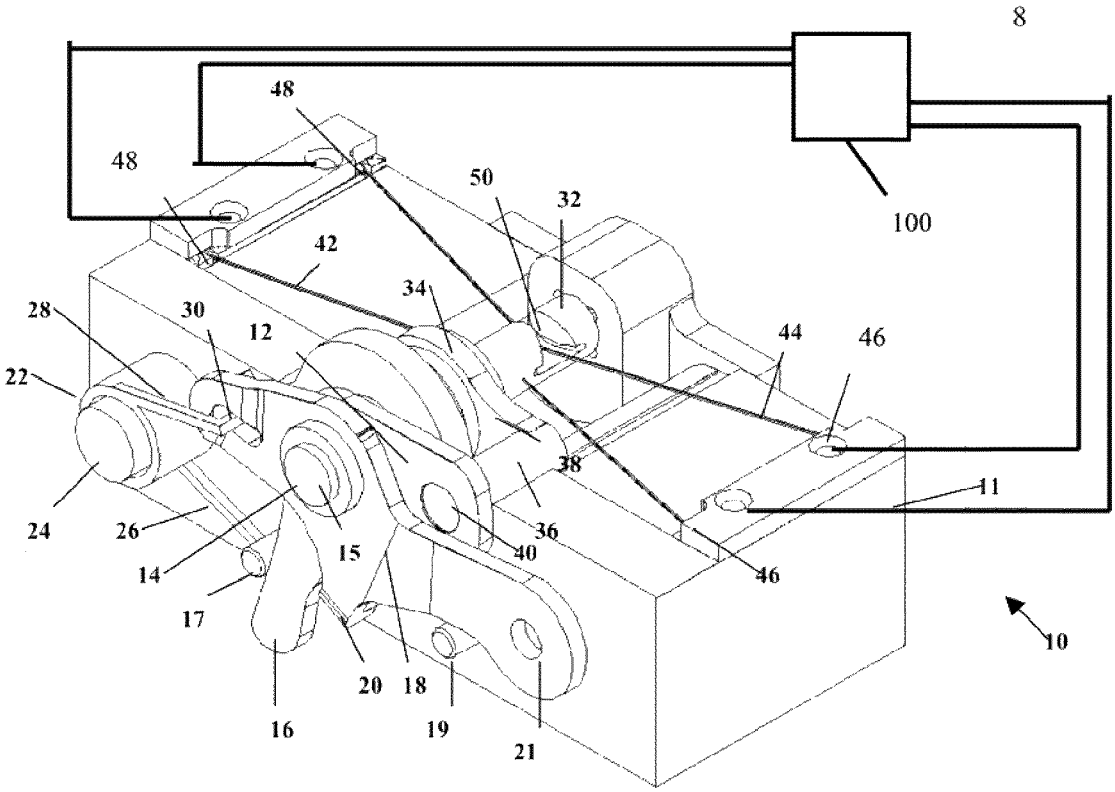
FIG. 1 shows an isolated view of a portion of a latch featuring a locking pivot actuator in the locked position, in accordance with a first embodiment of the invention.
Figure 2:
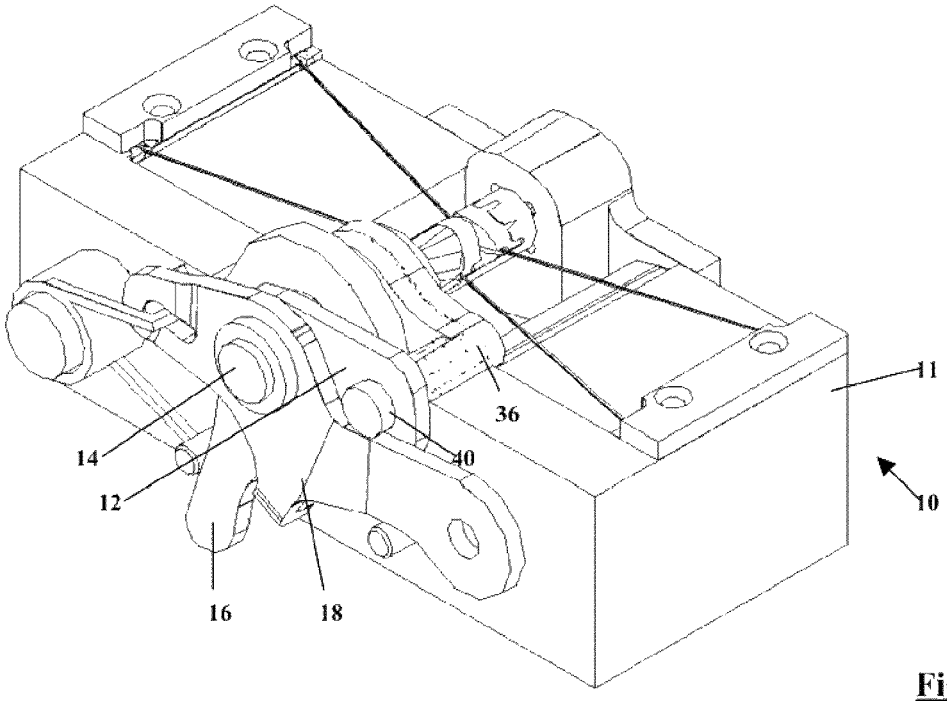
FIG. 2 shows an isolated view of the latch shown in FIG. 1 where the locking pivot actuator is in the unlocked position.

Referring now to FIGS. 1 and 2, a portion of a latch having a locking pivot actuator is shown generally at 10. Latch 10 is adapted to mount to a side door on a motor vehicle. Latch 10 includes a latch housing 11, a portion of which is illustrated in FIGS. 1 and 2. While the locking pivot actuator described herein is mounted directly to latch housing 11, it is contemplated that the locking pivot actuator could be mounted to an insert made to retrofit an existing latch. A first lever, namely release lever 12 is pivotally mounted around an axis 14 formed by lever rivet 15, and is movable between a "resting" position where a depending tab 16 on the lever rests against a post 17 and an "actuated" position where depending tab 16 is displaced away from post 17. When release lever 12 is moved to its actuated position, depending tab 16 actuates another lever (not shown) to engage a pawl (also not shown) release latch 10.

A second lever, namely auxiliary release lever 18 is also pivotally mounted around axis 14 adjacent to release lever 12, and is also movable between a "resting" position where it abuts against a post 19 formed in latch housing 11, and a "release" position where it is displaced away from post 19. A depending tab 20 on auxiliary release lever 18 abuts against depending tab 16 on release lever 12 when in the resting position. An aperture 21 is provided near an end of auxiliary release lever 18 to mount a door rod or cable (not shown) that is connected to the inner door handle (also not shown). Thus, actuating the door handle actuates the auxiliary release lever 18 towards the release position. A spring 22, mounted around a post 24 formed in latch housing 11, biases auxiliary release lever 18 towards its resting position. Spring 22 includes arms 26 and 28. Arm 26 abuts against post 17 formed in latch housing 11, and arm 28 terminates in a hook that is inserted into a slot 30 on auxiliary release lever 18.

A link pin 32 selectively couples auxiliary release lever 18 and release lever 12 together. A collar 34 rotatably mounted to link pin 32 is rotatable around axis 14. A locking pin 36 extends outwards from a radial arm 38 on collar 34, and extends through a hole 40 in release lever 12, kinematically coupling the pivoting motion of release lever 12 and link pin 32 around axis 14. As mentioned previously, link pin 32 is slidable along axis 14 and moves between a "locked" position and an "unlocked" position. A detente mechanism (not shown) constrains link pin 32 to motion along axis 14. When link pin 32 is in its unlocked position (FIG. 2), locking pin 36 extends through hole 40 and through the path of rotation of auxiliary release lever 18, thereby coupling the auxiliary release lever 18 and the release lever 12. Thus, actuating auxiliary release lever 18 pivots locking pin 36, and moves release lever 12 to release the latch. When link pin 32 is in its locked position (FIG. 1), auxiliary release lever 18 and release lever 12 are decoupled, and locking pin 36 does not extend through the path of rotation of auxiliary release lever

18. Moving auxiliary release lever 18 does not actuate locking pin 36, leaving release lever 12 unmoved in its resting position.

Link pin 32 slides between its locked and unlocked position via a pair of selectively contractible wires, namely SMA wires 42 and 44. SMA wires 42 and 44 are preferably formed from a either a binary or ternary shape memory alloy. Preferably, a ternary shape memory alloy comprising nickel, titanium and either palladium or hafnium could be used to form SMA wires 42. Each of SMA wires 42 and 44 is mounted to latch housing 11 by a pair of electrical terminals 46 and 48 respectively so that each SMA wire forms part of a circuit. In their rest state each of the terminals 46 and 48 are connected to a voltage source (typically the vehicle battery). In order to actuate link pin 32, a controller 100 selectively connects one of the terminals 46 or 48 to ground, causing the connecting SMA wire to contract.

SMA wires 42 and 44 are threaded through a slot 50 formed in link pin 32. Slot 50 is located between the centerline formed between the two terminals 46 and the two terminals 48, so that the two SMA wires 42 and 44 are routed along generally V-shaped paths like drawn bowstrings. When one of SMA wires 42 and 44 contracts, the contracting wire attempts to straighten, sliding link pin 32 closer to the centerline formed between the two terminals 46 or 48. Link pin 32 thus slides into or out of the locked position. While the leading SMA wire 42 or 44 contracts, the trailing SMA wire 42 or 44 stretches back to its original shape. Since link pin 32 uses the same axis of rotation as the release lever 12 and auxiliary release lever 18, the required displacement of link pin 32 to couple or decouple the two levers is less then existing linear toggle mechanisms, and a minimum of force is required.

What is claimed is:

1. An actuator, comprising:

a housing;

a first lever, pivotally mounted to the housing;

a second lever, pivotally mounted to the housing, wherein the first and second levers are rotatable about a common axis;

a link pin, slidably mounted to the housing;

a pair of spaced-apart selectively contractible wires, each of the pair of selectively contractible wires connected to the link pin and the housing, and operable to slide the link pin in one of two directions; and where sliding the link pin in a first direction kinematically couples the first and second levers and where sliding the link pin in a second direction kinematically decouples the first and second levers, wherein the link pin includes a locking pin that rotates about the common axis, wherein sliding the link pin in the first direction kinematically couples the locking pin with both the first and second levers.

2. The actuator of claim 1, wherein the ends of each of the pair of selectively contractible wires are connected at both ends to terminals mounted on the housing and that each selectively contractible wire is routed around its connection to the link pin to form an angle of less than 180° around the connection.

3. The actuator of claim 1, wherein the link pin is coaxial with the common axis.

4. The actuator of claim 3, wherein the locking pin rotates around the link pin.

5. The actuator of claim 1, wherein when the link pin is slid in the second direction the locking pin is kinematically coupled with only the first lever.

6. The actuator of claim 3, wherein the selectively contractible wires are threaded through a slot in the link pin, thereby connecting the selectively contractible wires to the link pin.

7. The actuator of claim 1, wherein the pair of selectively contractible wires are formed from a shape memory alloy.

8. The actuator of claim 7, wherein the shape memory alloy is a ternary shape memory alloy.

9. The actuator of claim 8, wherein terminals for each selectively contractible wire are electrically connected to a power supply.

10. The actuator of claim 8, further comprising a controller operable to selectively contract one of the pair of selectively contractible wires to move the link pin in one of the first and second directions.

* * * * *